US005370059A

United States Patent [19]

Raschbichler et al.

[11] Patent Number: 5,370,059

[45] Date of Patent: Dec. 6, 1994

[54] STRUCTURE FOR SUPPORTING TRACKWAY OF A TRACK FOLLOWING TRANSPORTATION SYSTEM, IN PARTICULAR, A MAGNETIC SUSPENSION RAILROAD

[75] Inventors: Hans G. Raschbichler; Luipold Miller, both of Ottobrunn, Germany

[73] Assignee: Thyssen Industrie AG, Essen, Germany

[21] Appl. No.: 207,851

[22] Filed: Mar. 7, 1994

Related U.S. Application Data

[63] Continuation of Ser. No. 954,918, Sep. 30, 1992, abandoned, which is a continuation of Ser. No. 878,044, May 4, 1992, abandoned, which is a continuation of Ser. No. 551,564, Jul. 11, 1990, abandoned.

[30] Foreign Application Priority Data

Jul. 25, 1989 [DE] Germany ..... 3924557
Aug. 26, 1989 [DE] Germany ..... 3928277

[51] Int. Cl.[5] ..... E01B 25/10

[52] U.S. Cl. ..... 104/124; 104/281; 248/317

[58] Field of Search ..... 104/111, 123, 124, 125, 104/89, 281; 248/317; 403/258, 262, 375, 315, 408.1

[56] References Cited

U.S. PATENT DOCUMENTS

| | | | |
|---|---|---|---|
| 3,631,807 | 1/1972 | Cherto | 104/124 X |
| 4,064,808 | 12/1977 | Nakamura et al. | 104/281 X |
| 4,620,358 | 11/1986 | Miller et al. | 104/281 X |
| 4,698,895 | 10/1987 | Miller et al. | 104/281 X |
| 4,934,276 | 6/1990 | Garpentin et al. | 104/111 |
| 5,097,769 | 3/1992 | Raschbichler et al. | 104/124 |

FOREIGN PATENT DOCUMENTS

| | | |
|---|---|---|
| 2918811 | 11/1980 | Germany . |
| 3412401 | 6/1985 | Germany . |
| 3404061 | 9/1985 | Germany . |
| 966127 | 7/1980 | U.S.S.R. . |

*Primary Examiner*—Robert J. Oberleitner
*Assistant Examiner*—Kevin D. Rutherford
*Attorney, Agent, or Firm*—Michael J. Striker

[57] ABSTRACT

A structure for supporting a trackway of a magnetic suspension railroad includes at least one support, at least one equipment element having an operational surface extending in a track direction, and an arrangement for securing the equipment element on the support in a predetermined position. The securing arrangement includes a connecting body fixedly attached to the support and boss structure projecting from the connecting body toward the equipment element and defining a first stop surface extending in a direction corresponding to a direction in which the operational surface extends, and cooperating with a second stop surface provided on the equipment element, when the equipment element is secured to the connecting body.

13 Claims, 6 Drawing Sheets

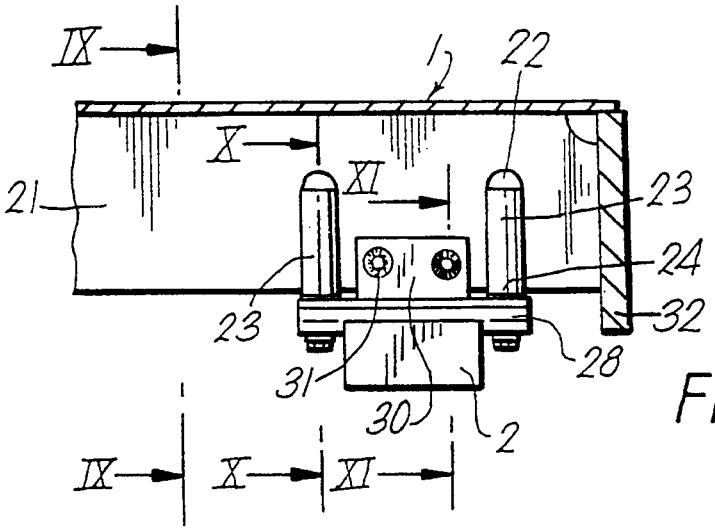
Fig. 8.
Fig. 9.
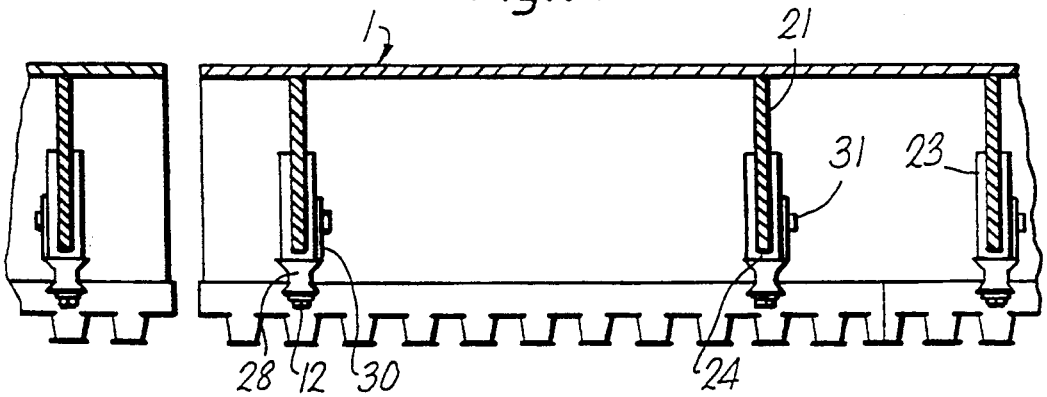
Fig. 10.
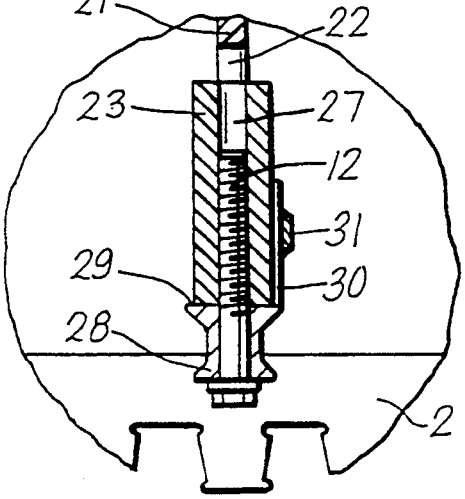
Fig. 11.
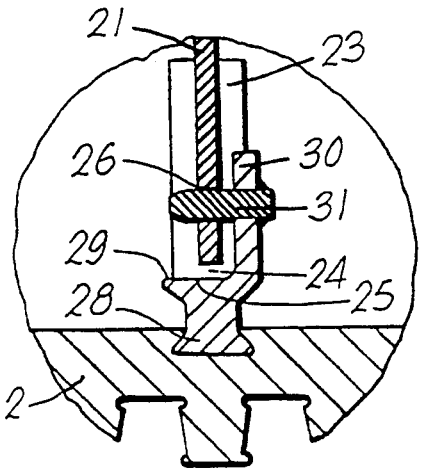

STRUCTURE FOR SUPPORTING TRACKWAY OF A TRACK FOLLOWING TRANSPORTATION SYSTEM, IN PARTICULAR, A MAGNETIC SUSPENSION RAILROAD

CROSS-REFERENCE TO RELATED APPLICATIONS

A copending application No. 07/551,553 now U.S. Pat. No. 5,097,769 has been filed.

This is a continuation of application Ser. No. 954,918 filed Sep. 30, 1992, which in turn is a continuation under Rule 1.60 of Ser. No. 878,044, filed on May 4, 1992, which in turn is a continuation application of Ser. No. 551,564, filed on Jul. 11, 1990, all now abandoned.

BACKGROUND OF THE INVENTION

The invention relates to a structure for supporting a trackway of a track following transportation system, particularly, of a magnetic suspension railroad, comprising at least one support, at least one equipment element having an operational surface extending in a line direction, and means for securing the equipment element on the support in a predetermined position relative to the support. The securing means includes a connecting body provided with a first stop surface extending in a direction of the operational surface of the equipment element, and cooperating with a second stop surface formed on the equipment element, and bolts for securing the equipment clement to the connecting body. The invention also relates to a method of manufacturing the supporting structure of the invention.

Trackways in cement or steel version for track following transportation systems comprise generally a plurality of supporting structures extending one behind the other along the track and on which are mounted all equipment elements necessary for operation of the system, in particular for transporting, guiding, driving, braking, etc. of system cars. In a magnetic suspension railroad, for example, each supporting structure includes a bent-resistant support to which equipment elements in a form of lateral guide strips, reaction strips of an elongate stator of a motor or the like are attached. At that, the support is supported by studs anchored in a foundation by any appropriate method. The equipment parts are attached to the support in such a manner that their operational surfaces, upon securing the support on studs, extend along a predetermined track course, i.e. a given line.

To enable vibration-free movement at large speeds to, i.e., 500 km/hr and to prevent knocking of cars on the operational surfaces, the actual coordinates of a single point of the operational surface should deviate from the set coordinates of this point, that is from X-, Y-, and Z-coordinates of the theoretical line, at most by few millimeters. However, manufacturing tolerances of supporting structures in steel or cement version do not permit to achieve such accuracy. Therefore, a supporting structure should be manufactured with a possibility of adjusting the position of an equipment element on the support after the support is secured on the studs (ZEV-Glas. Ann. 105, 1981, No. 7/8, pages 205–215). This made possible to cope with conventional manufacturing tolerances and resulting deviations of actual parameters of the operational surfaces from theoretical ones which deviations are subsequently taken care of by proper adjustments.

The foregoing adjustment requires a lot of time and cannot be effected on a construction site at all possible weather conditions. A solution to this problem is suggested in U.S. Pat. No. 4,698,895 that discloses a supporting structure which permits to eliminate the adjusting step. The supporting structure of the U.S. Pat. No. 4,698,895 is characterized in that the connecting bodies are provided with depressions (blind bores) and thread bores, and the equipment elements are positioned with respect to the support with spacing bushings and then secured to the support by securing bolts which are screwed into the thread bores. At that, the depressions and the thread bores of each supporting structure should be formed in accordance with their locations with respect to the studs and respective line coordinates (set coordinates of operational surfaces, corresponding track portions, etc.) in such a manner that with the use of spacing bushings of the same length, the respective equipment elements have operational surfaces properly positioned irrespective of whether the equipment elements are secured to the supporting structure before or after the installation. This provides an advantage that all operations required for securing the equipment elements on the supporting structure in accordance with the track course, can be carried out at a factory, and comparatively not expensive spacing bushings and securing bolts are required for securing and positioning of the equipment elements.

However, the known supporting structure requires that the equipment elements be mounted on supporting bodies parallel to axes off the depressions and thread bores. This is not always possible or at least presents some difficulties, especially when there is provided an additional redundant and different securing system with form-locking connecting elements that extend transverse to the axes of depressions or thread bores, for preventing falling out of an equipment element upon failure of securing bolts. Further, using off spacing bushings means use off additional mounting elements which increases the costs of manufacturing and installation of the whole trackway. Finally, the known securing system does not make it possible to obtain an optimal dynamic behavior because the equipment elements are secured on the supports with intermediate member and not directly.

SUMMARY OF THE INVENTION

The object of the invention is a supporting structure in which the spacing bushings are disposed with, and an equipment element is secured directly to a connecting member and is movable, during assembly, transverse to the thread bores without compromising the advantage of arranging it in accordance with the track line. Another object of the invention is a method of manufacturing such a supporting structure. The object of the invention is achieved by providing a supporting structure in which the first stop surfaces are formed on bosses provided on the connecting body and extending in a direction in which the equipment element is provided, and the second stop surfaces abut first stop surfaces.

According to the method of the invention, in the first stage, the support in steel or cement version is formed with conventional manufacturing tolerances, and the equipment part is formed with tolerances stipulated by the track course with forming, in a subsequent working operation, the appropriate bores in the connecting body with tolerances likewise stipulated by the track course. During the first stage, the support is provided with the connecting body with bosses that are longer than the maximum length required for their function in the trackway. In a subsequent step, the first stop surface is formed by machining the bosses with tolerances stipulated by the track course, during which operation the excess material is removed.

The first stop surface is formed on projecting bosses of the connecting body and no additional spacing bushings or the like are needed any more. The equipment element is positioned by being shifted transverse to the axes of thread bores for securing bolts. The first stop surfaces and the thread bores are formed generally with computer-controlled material removing tools in accordance with the track course so that operational surfaces, upon the equipment element being secured with bolts, automatically extend in accordance with the track course, i.e. with the line.

The present invention both as to its construction so to its method of operation, together with additional objects and advantages thereof, will be best understood from the following detailed description of specific embodiments when read in connection with the accompanying drawings.

BRIEF DESCRIPTION OF THE DRAWINGS

FIGS. 7–11 show views similar to views shown in FIGS. 2–6 of another embodiment of a supporting structure according to the present invention;

DETAILED DESCRIPTION OF THE PREFERRED EMBODIMENTS

The supporting structure will be now described, by way of an example, as being used in a magnetic suspension railroad driven with a motor having an elongate stator. The supporting structure, however, with corresponding modifications can also be used in other trackway transport systems.

Figure 1:
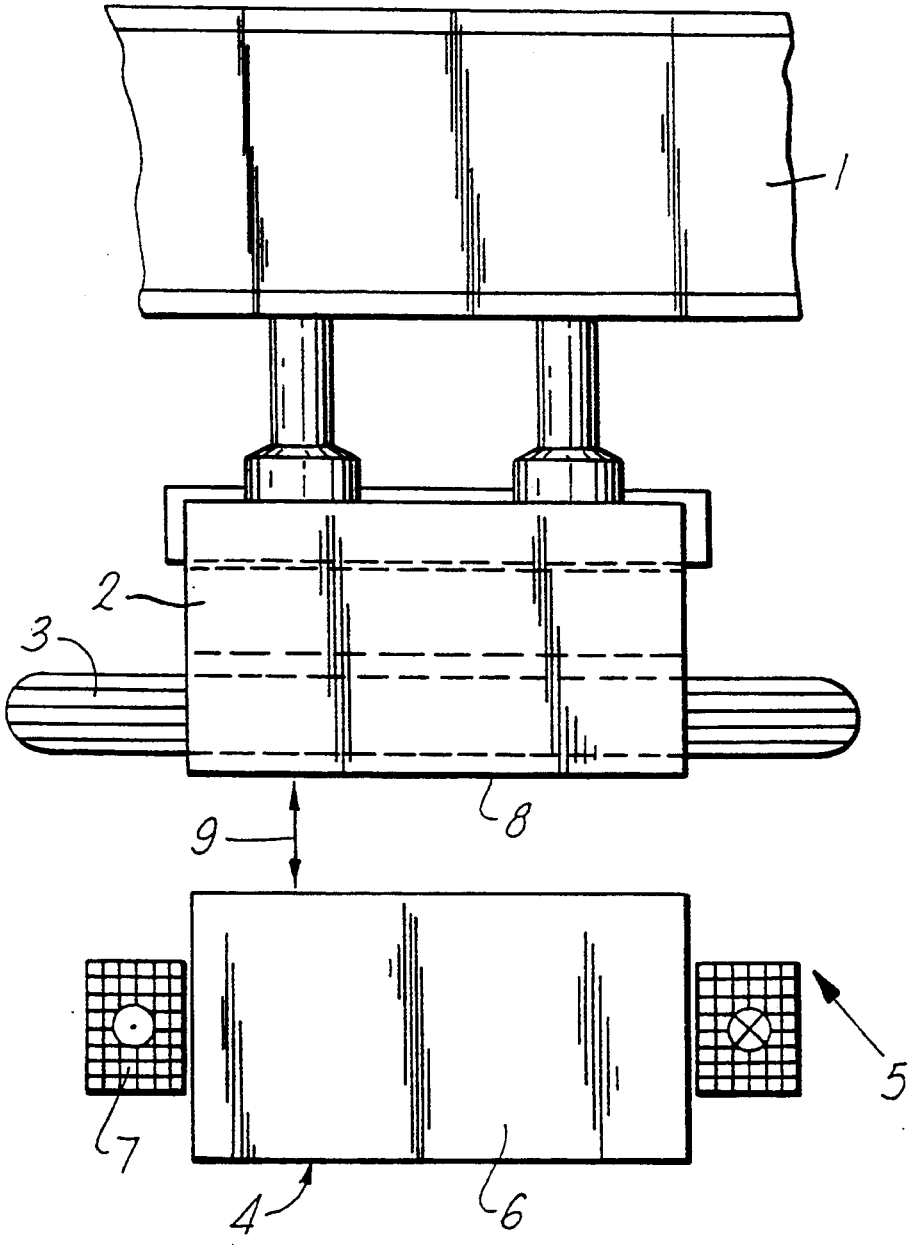
FIG. 1 shows a schematic view of a magnetic suspension railroad and its trackway.

A magnetic suspension railroad with a long-stator synchronous motor, shown in FIG. 1, generally has a trackway consisting of a plurality of component supporting structures arranged in the longitudinal direction of the trackway one after another and having a length, for example, about 24 m. Each supporting structure comprises at least one lateral support 1 which is supported with studs (not shown) that are fixed in a fundation. Each support includes generally a plurality of the equipment elements 2 that, for example, consist of a stack of sheets with grooves and form the elongate stator of the motor and have a length, for example, of 2 m. In the grooves of the equipment elements 2, are located windings 3 through which a multi-phase current having a variable amplitude and frequency, flows.

The exication field of the elongate stator is provided by support magnets 4 which are connected to a vehicle 5 moved along the track and only schematically shown in FIG. 1. Each support magnet consists of a magnet core 6 and an excitation winding 7. Further to the function of magnetically suspend the vehicle 5, the support magnets simultaneously provide the excitation field of the long-stator of the motor. Generally, the equipment elements 2 are provided on both sides of the supports 1 of the supporting structure, an the support magnets 4 are arranged on both sides of the vehicle 5.

The bottoms of all eqipment elements 2 have operational surfaces 8 which should be spaced from outer polar surfaces of the magnetic cores 6, in the suspended and moving condition of the vehicle 5, by a predetermined distance 9, for example, 10 mm. To this end, the operational surfaces 8 should be arranged parallel to the theoretical line with small tolerances and should adjoin to each other in the joint areas between the single equipment elements 2 with a small shift or displacement.

Supporting structures of an above-described type are generally known (please refer, i.e., to U.S. Pat. No. 4,698,895) and need not be described in more detail.

According to the invention, the support 1 shown in FIGS. 2–6 and in steel version, is provided on its bottom side with connecting bodies 11 spaced in a longitudinal direction of the track and formed as web plates extending transverse to the track. The equipment elements 2 are secured to the connecting bodies with bolts 12. The connecting bodies 11 are provided with bosses 14 which extend toward the equipment elements 2, i.e. which project downward from the connecting bodies and transverse to the track direction in FIG. 2 and whose free end surfaces define first stop surfaces 15 (see FIGS. 2 and 6). Each boss 14 and a respective portion of a respective connecting body 11 have a bore 16 for receiving a respective connecting bolt 12. The bores 16 are preferably threaded bores in which the bolts 12 can be secured without use of nuts.

The equipment elements 2 are provided, on sides thereof adjacent to the connecting bodies 11, here on upper surfaces thereof, with crosspieces 17 the upper surfaces of which define second stop surfaces 11 (FIGS. 2 and 6) extending parallel to operational surfaces 8 of respective equipment elements 2. The crosspieces 17 are preferably fixedly connected with respective equipment elements 2, for example, by means of form-locking groove and tongue joint and additional glueing. Preferably, the stop surfaces 18 are equidistantly spaced from the operational surfaces 8. The distance between the crosspieces 17 in the longitudinal direction of the track corresponds to that of connecting bodies 11 and bosses 14.

Figure 2:
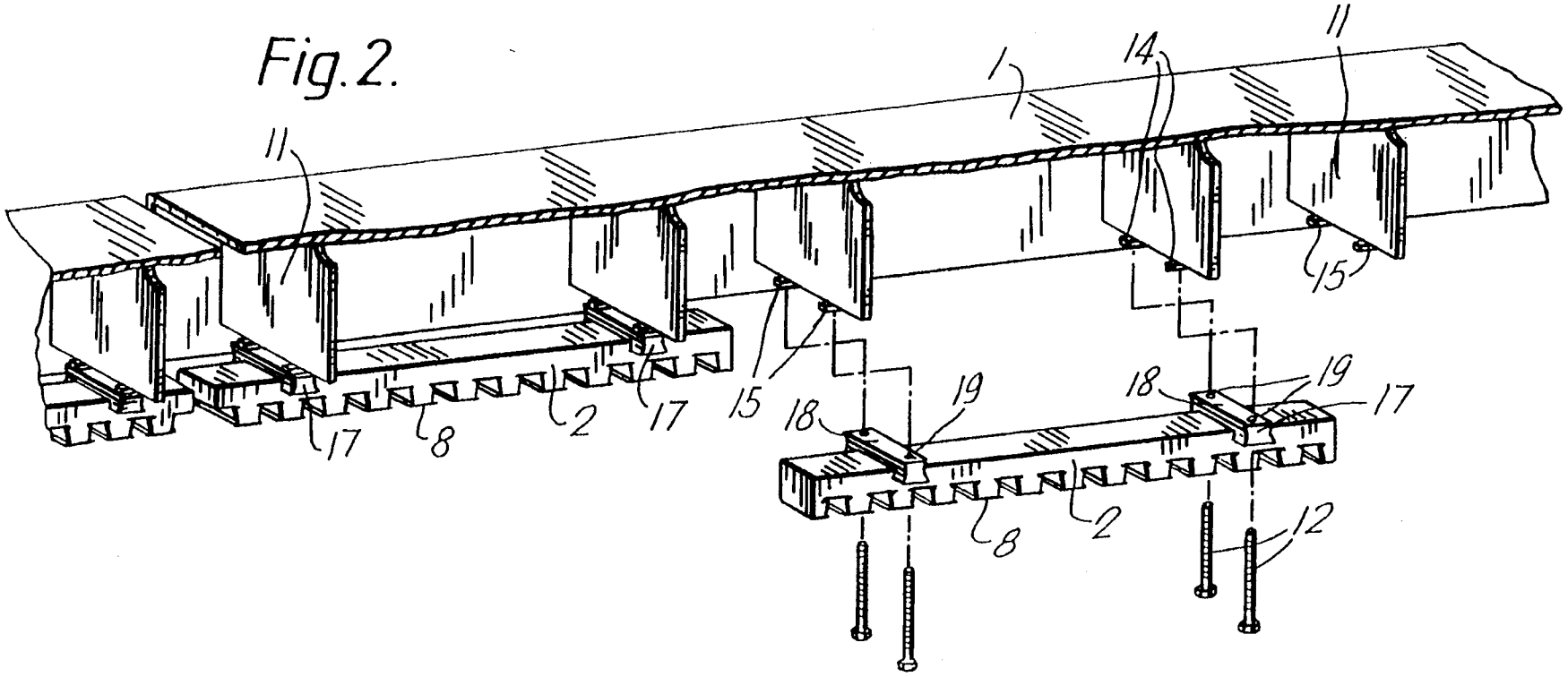
FIG. 2 shows a perspective and partially exploded view of a supporting structure according to the invention in a steel version.
Figure 3:
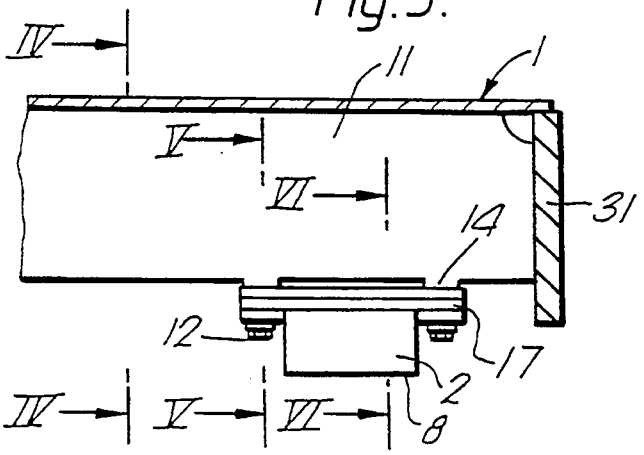
FIG. 3 shows a cross-sectional view of the supporting structure shown in FIG. 2.
Figure 4:
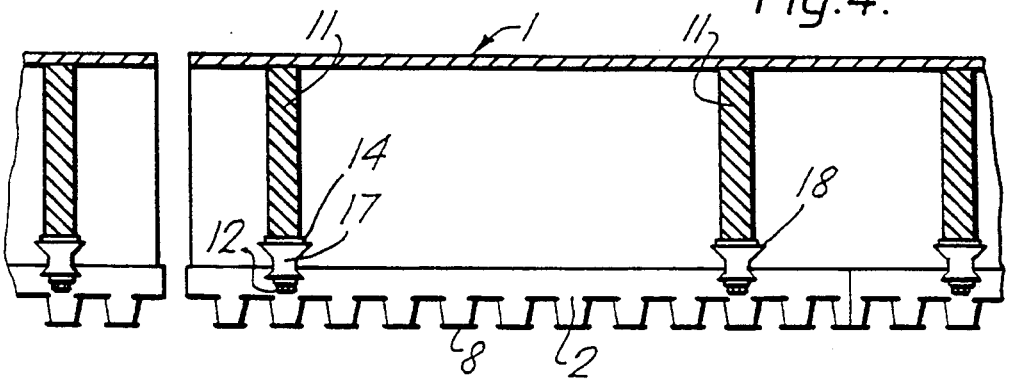
FIG. 4 shows a cross-sectional view along line IV—IV in FIG. 3.
Figure 5:
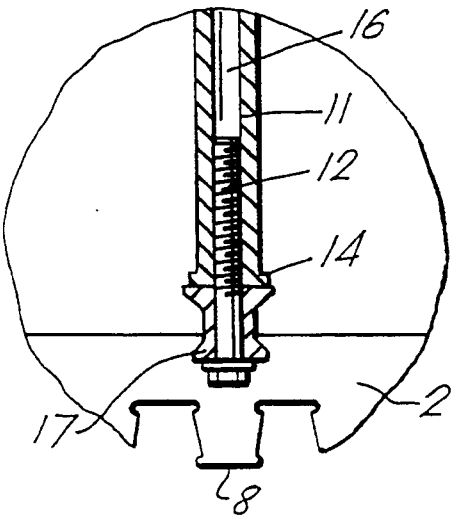
FIG. 5 shows a cross-sectional view along the line V—V in FIG. 3.
Figure 6:
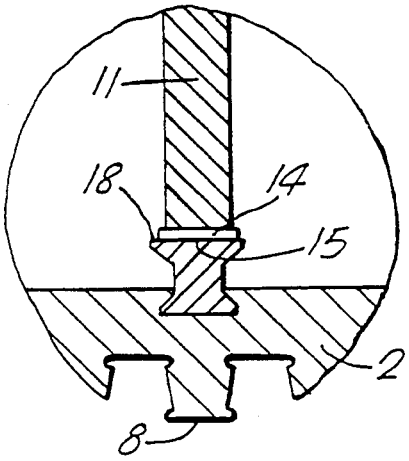
FIG. 6 shows a cross-sectional view along the line VI—VI in FIG. 3.
Figure 7:
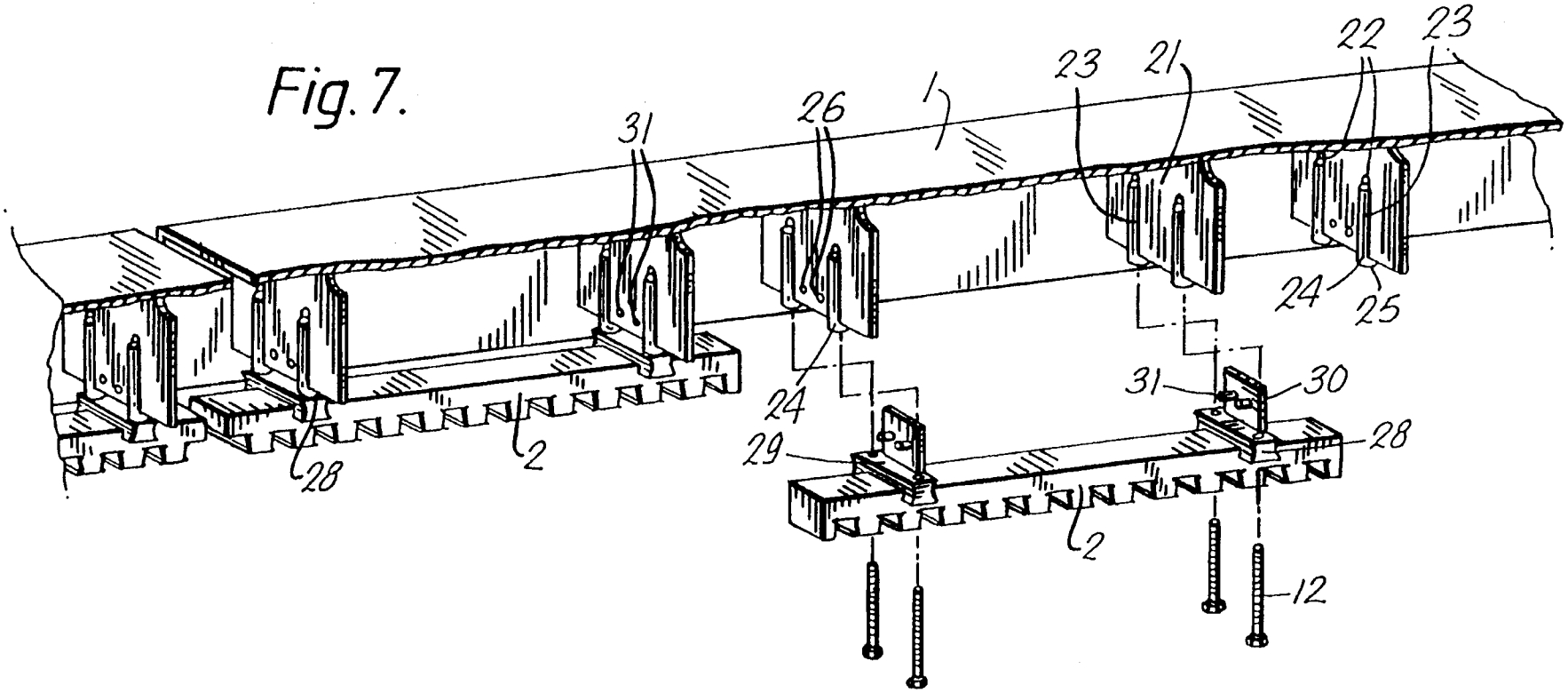

The crosspieces 17 are provided at lateral ends thereof projecting beyond the equipment elements, with bores 19 (FIG. 2) for receiving the bolts 12. Preferably, each equipment element 2 (as shown in FIG. 2) is provided with two crosspieces 17 with each crosspiece having two openings 19. The distance between bores 19 in each crosspiece 17 corresponds to the distance between bores 16 of a respective connecting body 11. Thereby, each equipment element 2 is secured to a corresponding support 1 with four bolts 12.

For mounting the equipment element 2, the stop surfaces 15 and 18 are brought against each other, the bores 16 and 19 are aligned, and the bolts 12 are screwed in until their heads firmly abut the buttom surfaces of the crosspieces 17. The approximation of the equipment elements 2 to the bosses 14 can practically be done from any desired direction.

In order to insure that the operational surfaces 8 of all equipment elements 2 of any supporting structure, after mounting, automatically are arranged, within permissible tolerances, in positions along the track according to selected positions of a given line, all equipment elements 2 are formed substantially identical whereas the corresponding first stop surfaces 15 and bores 16 are formed in accordance with the line, i.e. such that they meet the prescriptions of the line. This means in the embodiment as shown in FIG. 2–6, that all stop surfaces 15 of any supporting structure are arranged on a surface that has the same course as the portion of the line which is assigned to this particular supporting structure. Hence, after securing of all equipment elements 2 to this particular supporting structure, also the surface formed of the respective operational surfaces 8, has a course corresponding to the respective line portion. Finally, the relative position of bosses 14 on each support is so selected that after aligning of all supports one after another in the correct sequence or order along the trackway and after securing the supports, the operational surfaces 8 of all equipment elements 2 lie on a surface prescribed by the line, and no displacement, except within permissible tolerances, in any direction in joint areas of single equipment elements or supports is present. Insofar, the displacement should be small with lateral displacement (normally at most a few millimeters) and even smaller with displacement in height.

Actually, the operational surfaces 8 of single equipment elements 2 and also the stop surfaces 15 and 18 associated therewith are preferably in planes such that the total operational surface of each supporting structure forms a polygonal course from a plurality of plane operational surfaces 8. The deviation of actual value from a set value caused thereby is acceptable in view of the large radii of a curvature of different tracks. The stop surfaces 15 corresponding to an equipment clement 2 may lie as in the same plane so in different planes. In the latter case, the stop surfaces 18 should also lie in corresponding different planes.

Forming the first stop surface 15 serving as a reference surface for positioning of the operational surface, is effected as follows. At the end of a manufacturing process, the support 1 is provided with connecting bodies 11 having bosses 14. The bosses 14 have a length which is greater than the maximum required length of a boss 14 inside the trackway. Then, the bosses 14 are, preferably similarly to a known method (see U.S. Pat. No. 4,698,895), processed in a subsequent working operation with a computer-controlled tool. The advantage of this consists in that the known method and the apparatus for carrying it out need only small modification comprising providing an additional tool in a form of an end milling cutter or the like that machines each single boss 14 to a required length, so that a stop surface 15 obtained as a result, provides a fixed reference plane for the required angular position with respect to a stationary coordinate system. By using a combined spot-facing drill/end milling cutter tool or the like during the same working operation, the bores 16 can be formed with axes extending perpendicular to the stop surface 15 and which bores can be provided with a thread. These working steps can be performed one after another or, at least partially, simultaneously and, preferably, in a climate-controlled environment under controlled conditions and with taking care of all parameters which are important for the line (see U.S. Pat. No. 4,698,895). The securing of equipment elements 2 can alternatively be conducted at the factory or at the construction site, as necessary, after mounting of the support because adjustment is not required.

When four bolts 12 are used for each equipment element 2, additional securing means is not provided and the system is redundant. Even if any bolt 12 fails, no functional disturbance occurs. The same is true when one bolt fails in each crosspiece 17. If both bolts 12 at the same end of a crosspiece 17 fail, then the equipment element 2, because of its own rather substantial weight, will fall down or, due to forces generated by moving the vehicle 5 along the trackway, will be displaced in the acting direction of these forces. As a result, both other bolts 12 may brake or become bent. In each case, in a joint area adjacent to an affected equipment element 2, a functional disturbance, in a form of a large displacement between adjacent operational surfaces 8, occurs.

To avoid this unacceptable inappropriate function, according to a further embodiment of the invention shown in FIGS. 6–11, the fixing means is not only redundant but also diversified and has in addition to the embodiment shown in FIGS. 2–6, means which, upon failure even of all bolts 12, limit the fall or displacement of the equipment element itself to a predetermined magnitude. This means comprises preferably form-locking fixing elements that are not loaded under normal operation and become operational only after failure of the fixing bolts.

In the embodiment shown in FIGS. 7–11 parts identical to those of FIGS. 2–6, are designated with the same reference numerals. The position of the equipment element 2 on the support 1 in the embodiment of FIGS. 7–11 is substantially the same as in the embodiment of FIGS. 2–6 except that the bosses and the first stop surfaces are not formed directly on the connecting bodies. Instead, the connecting bodies 21 are provided with bores 22 in which rods 23 are secured, for example, by welding. The free ends of the rods 23 projecting from bores 22 form bosses 24 (FIGS. 7 and 11) extending beyond the connecting bodies 21. The end surfaces of these bosses 24 form first stop surfaces 25. What has been said with respect to bosses 14 and first stop surfaces 15 equally applies to bosses 24 and stop surfaces 25, so that only a small change in the first step of manufacturing of the support 1 occurs. Additionally, the connecting bodies 21 have two openings 26 with axes extending parallel to the stop surfaces 25. Bores 27 having axes extending transverse to the stop surfaces 25 are formed in rods 23. The bores 27, preferably, have a thread.

The equipment elements 2 are equipped with crosspieces 28 which define second stop surfaces 29 (FIG. 11). The crosspieces 23 are similar to crosspieces 17. In addition, the crosspieces 23 have stays 30 (FIG. 11) formed integrally therewith or otherwise attached thereto and extending transverse to the stop surfaces 29 and parallel to the connecting bodies 21. Bolt-like safety elements 31 having their axes extending parallel to stop surfaces 29, are secured to the stays 30, respectively, i.e., by welding. The distance between the axis of a safety element 31 and a stop surface 29 corresponds to that of an axis of an opening 26 from a respective stop surface. The position of a connecting body 21 is so selected that the safety element 31, at mounting of an equipment element 2, extends parallel to stop surfaces 25 and 29 when the safety element is received within the opening 26. When the stop surfaces 25 and 29 abut each other, the securing bolts 12 are inserted into the openings 27 and secured therein.

The cross-section of the opening 26 is somewhat larger than the cross-section of the safety element 31. This facilitates, on one hand, mounting of the equipment element and, on the other hand, enables to limit the fall or displacement of a crosspiece 28, if both bolts 12 fail, to a predetermined Value, i.e., 2–3 mm. Thereby, a large displacement between adjacent operational surfaces 8 in joint areas of equipment elements is prevented. This also permits to effect a quick repair in case of failure of both respective securing bolts 12. Alternatively, each car may be equipped with a distance sensor that senses a large displacement in a joint area of equipment elements 2, so that each car on the track way can automatically register a possible error.

The safety elements 31 are so formed that they, for all equipment elements 2, are located in the scene place and have the same shape and size. The openings 26 are formed with, preferably, a computer-controlled tool, i.e., a drill, during forming the bores 27 and the stop surfaces 25. This insures that the axis of the opening 26 extends parallel to the stop surface 25 and is spaced therefrom by a distance corresponding to the spacing of the axis of the safety element 31 from the second stop surface 29. This can be effected in a simple manner by providing a known apparatus (see U.S. Pat. No. 4,698,895) with an additional tool and, during forming the opening 26 of a connecting body 21 during a subsequent working operation, using the stop surface 25 of this connecting body as a reference for control coordinates of a respective tool.

Figure 12:
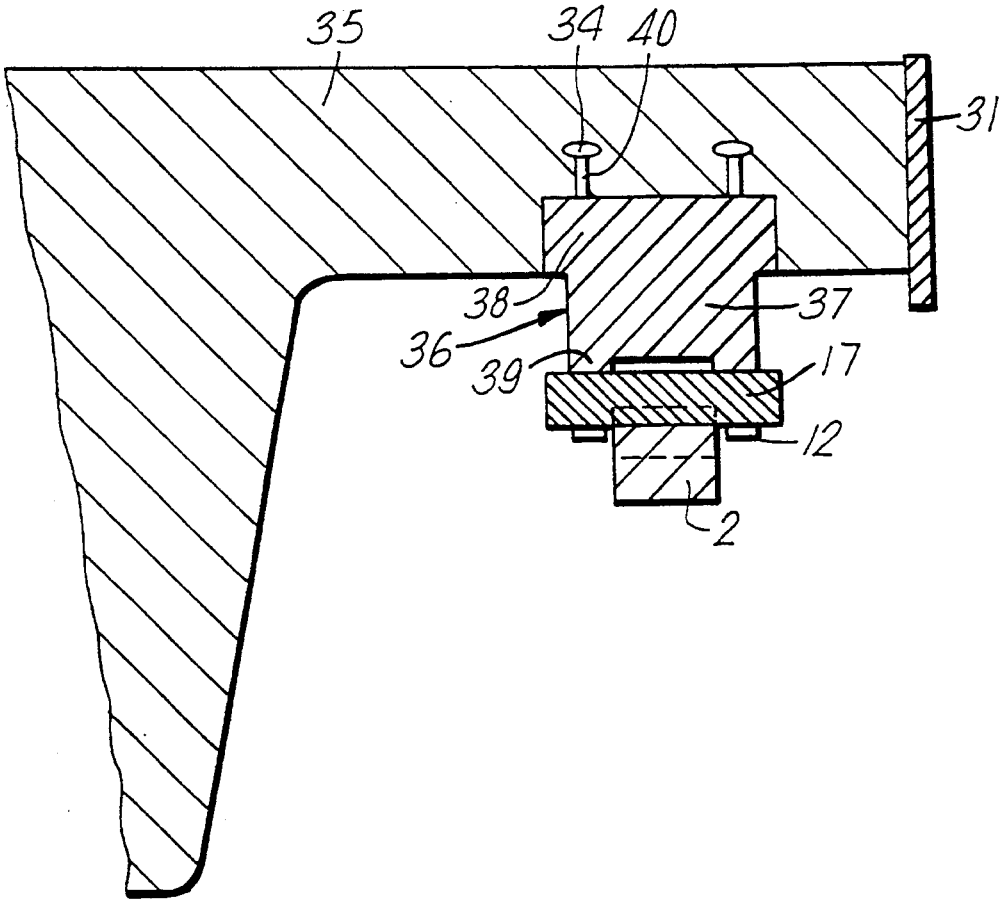
FIG. 12 shows a transverse cross-sectional view of a supporting structure according to the invention in a cement version.
Figure 13:
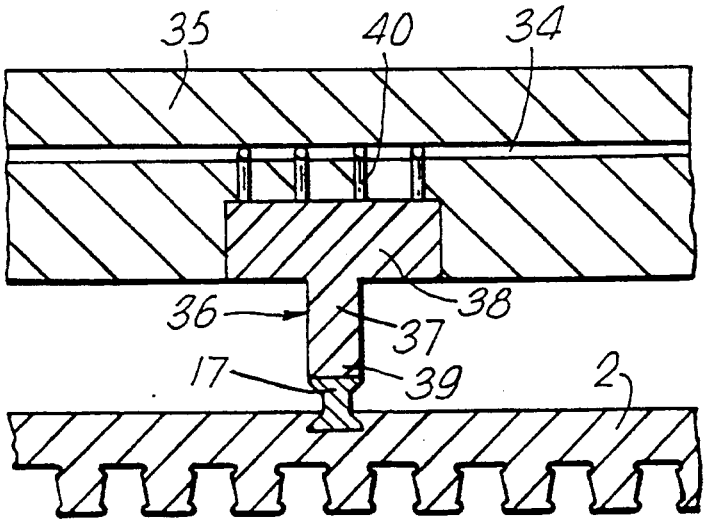
FIG. 13 shows a longitudinal cross-sectional view off a supporting structure according to the invention in a cement version.

In a cement version, supports 35 with loose reinforcement 34 can have at the bottom sides, as shown in FIGS. 12 and 13, connecting bodies 36 which are spaced in the longitudinal direction of the track. These bodies 36 are preferably made of steel in a form of a web plate extending transverse to the track. The connecting bodies 36 have flange-like mounting plates 38 at one end thereof, and bosses 39 defining first stop surfaces and corresponding to bosses 14 and 24, at the other end thereof. The equipment elements 2 are being attached to these bosses 39. In contrast to the steel version of FIGS.. 1 through 11, the mounting plates 38 during forming of supports 35 are embedded in cement and, as shown by reference numeral 40 in FIGS. 12 and 13, are preferably fixedly connected with reinforcement 34. In all other respects, the arrangement of FIGS. 12 and 13 is similar to that of FIGS. 1–11.

As it is particularly shown in FIG. 12, the mounting plate 38 is embedded in the cement, preferably, in such a manner that its bottom surface is flash with the bottom surface of support 35. In such a case, the intermediate portion 37 of the connecting body 36 can be very short or even completely eliminated and bosses 39 can be formed directly on the mounting plate 38. In the latter case, a very compact and mechanically stable structure is obtained.

If need be, the support 35 in the region of the bosses 39 can be provided with recesses that facilitate positioning of the tool for forming the bosses 39.

The invention is not limited by the described embodiments, and various modifications can be made therein. For example, it is not necessary that the bores 16 and 27 for receiving bolts 12 are formed in bosses 14 or rods 23. They can be formed in regions of connecting bodies 11, 21 and equipment elements 2 that lie outside of stop surfaces 15 and 25. It is further possible to use more or less than four bolts 12 or more than two crosspieces 17, 28 for attaching an equipment element 2. Also, the number of equipment elements 2 per each support may vary. In addition to equipment elements 2, other equipment elements, for example, lateral guide rails 32, shown in FIGS. 3 and 8 can be attached to the supporting structure. In this case, the form-locking connection of form-locking fixing elements preferably acts in the same direction in which forces generated during normal operation act. Further, the shape and-the position of stop surfaces 15 and 18 or 25 and 29 can vary inasmuch they do not change the predetermined position of the equipment elmements 2 on the supports 1 and 36.

Generally, it is not intended that the invention be limited to the details shown, since various modifications and structural changes may be made without departing in any way from the spirit and scope of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A structure for supporting a trackway of a track following transportation system formed as a magnetic levitation railroad, the supporting structure comprising at least one support; at least one equipment element having an operational surface; and means for securing said equipment element to said support, said securing means including a connecting body fixedly attached to said support and provided with first stop surface means forming a first stop surface, and second stop surface means, formed as cross-pieces which extend at least substantially a width of said equipment element, provided on said equipment element and forming a second stop surface, said support with said connecting body and said first stop surface means forming a first integral element while said equipment element with said second stop surface means forming a second integral element, said integral elements and said stop surfaces being formed so that when said first integral element and said second integral element are placed over one another, said first and second stop surfaces form a single continuous contact surface and said operational surface of said equipment element is spaced from said contact surface at an identical distance from said contact surface over a course of the trackway, said securing means also including securing elements which secure said integral elements with one another when said integral elements are placed over one another.

2. A structure as defined in claim 1, wherein said first stop surface means are formed as bosses attached to said connecting body, while said second stop surface means are formed as said cross-pieces attached to said equipment element.

3. A structure as defined in claim 2, wherein said bosses are provided with bores while said cross pieces are provided with bores alignable with said bores of said bosses, said securing elements include bolts extending through said bores of said bosses and said bores of said cross-pieces when said bores are in alignment with each other.

4. A structure as defined in claim 3, wherein said bores have substantially vertical axes, said bolts extending in a substantially vertical direction through said bores.

5. A structure as defined in claim 1, wherein said first stop surface means are formed as rods provided on said connecting body while said second stop surface means are formed as said cross-pieces provided on said equipment element.

6. A structure as defined in claim 5, wherein said rods are provided with bores while said cross-pieces are provided with bores which are alignable with said bores of said rods, said securing elements include bolts extending through said bores of said rods and bores of said cross-pieces when said bores are in alignment with each other.

7. A structure as defined in claim 6, and further comprising safety means for providing an additional safety of connection of said integral elements with one another, said safety means including openings provided in said connecting body and bolt elements provided on said cross-pieces and extending through said openings.

8. A structure as defined in claim 7, wherein said openings have substantially horizontal axes, said bolt elements extending through said openings in a substantially horizontal direction.

9. A structure as defined in claim 5, wherein said bores have substantially vertical axes, said bolts extending through said bores in a substantially vertical direction.

10. A structure as defined in claim 1, wherein said operational surface of said equipment element is spaced exclusively downwardly from said contact surface.

11. A method of manufacturing a supporting structure of a trackway following transportation system, formed as a magnetic levitation railroad, the method comprising the steps of providing at least one support; fixedly attaching to said support a connecting body having a first stop surface means forming a first stop surface so that said support with said connecting body and said first stop surface means form a first integral element; providing at least one equipment element having an operational surface and second stop surface means, formed as cross-pieces which extend at least substantially a width of said equipment element, forming a second stop surface so that said equipment element with said second stop means form a second integral element; forming said first integral element and said second integral element and also said first stop surface and said second stop surface so that when said integral elements are placed over one another, said first and second stop surfaces together form a single continuous contact surface while said operational surface of said equipment element is spaced from said contact surface at an identical distance from said contact surface over a course of the trackway; and securing said integral elements with one another when said integral elements are placed over one another.

12. Method as defined in claim 11, wherein said securing of said integral elements with one another includes securing with bolt means extending substantially perpendicular to said first and second stop surfaces.

13. A method as defined in claim 11, wherein said operational surface of said equipment element is spaced exclusively downwardly from said contact surface.

* * * * *